United States Patent [19]

Agnemo et al.

[11] Patent Number: 5,035,772

[45] Date of Patent: Jul. 30, 1991

[54] METHOD FOR TREATING BLEACHED LIGNIN CONTAINING CELLULOSE PULP BY REDUCING α-CARBONYL AND γ-CARBONYL GROUPS AND CONVERTING SHORT-WAVE QUANTA TO LONG-WAVE LIGHT QUANTA

[75] Inventors: Roland A. Agnemo; Birgitta E. Lundén-Lundgren, both of Domsjö, Sweden

[73] Assignee: Mooch Domsjo AB, Sweden

[21] Appl. No.: 415,394

[22] Filed: Sep. 28, 1989

Related U.S. Application Data

[63] Continuation of Ser. No. 160,809, Feb. 26, 1988, abandoned.

[30] Foreign Application Priority Data

Feb. 27, 1987 [SE] Sweden ..... 8700843

[51] Int. Cl.[5] ..... D21C 9/16; D21H 17/05; D21H 17/63; D21H 17/70

[52] U.S. Cl. ..... 162/72; 162/63; 162/78; 162/80; 162/84; 162/158; 162/162; 162/182

[58] Field of Search ..... 162/72, 76, 80, 84, 162/83, 78, 162, 157.6, 158, 182, 63

[56] References Cited

U.S. PATENT DOCUMENTS

| | | | |
|---|---|---|---|
| 3,017,316 | 1/1962 | Rapson et al. | 162/80 |
| 3,068,141 | 12/1962 | MacClaren | 162/80 |
| 3,393,122 | 7/1968 | Marshall | 162/84 |
| 4,008,121 | 2/1977 | Coleman | 162/124 |
| 4,339,238 | 7/1982 | Fringeli et al. | 162/162 |
| 4,401,810 | 8/1983 | Tang | 162/80 |

FOREIGN PATENT DOCUMENTS

| | | | |
|---|---|---|---|
| 187477 | 7/1986 | European Pat. Off. | 162/78 |
| 536271 | 3/1977 | U.S.S.R. | 662/76 |

*Primary Examiner*—Steve Alvo

*Attorney, Agent, or Firm*—Sughrue, Mion, Zinn, Macpeak & Seas

[57] ABSTRACT

A method for treating lignin containing pulp, subsequent to being bleached by:

a) always treated with at least one chemical, which chemically reduces α-carbonyl and γ-carbonyl groups in the lignin; and in at least one further step is b) treated with at least one chemical, which will block the phenolic hydroxyl groups of the lignin and/or c) supplied with at least one chemical, which will convert short-wave light quanta to long-wave light quanta.

According to a preferred embodiment of the invention cellulose pulp is subjected to all of the above treatment processes, i.e. a)+b)+c) and is washed after the two initial treatment stages. The method solves the problem of yellowing of lignin containing pulps, e.g. high yield pulp.

19 Claims, No Drawings

METHOD FOR TREATING BLEACHED LIGNIN CONTAINING CELLULOSE PULP BY REDUCING α-CARBONYL AND γ-CARBONYL GROUPS AND CONVERTING SHORT-WAVE QUANTA TO LONG-WAVE LIGHT QUANTA

This is a continuation of application Ser. No. 07/160,809, filed Feb. 26, 1988, and now abandoned.

TECHNICAL FIELD

The present invention relates to a method for stabilizing the brightness of bleached lignin containing cellulose pulp. The lignin content of the pulp may range from extremely low values to very high values. The cellulose pulp may derive from any known pulp manufacturing process, which processes may, for example, be divided into chemical, chemimechanical and mechanical processes. The invention can be applied to particular benefit with pulps that have a high lignin content, e.g. groundwood pulp (including pressure groundwood pulp, so-called PGW), refiner pulp, thermomechanical pulp and chemithermomechanical pulp. Such pulps can be produced from both softwoods and hardwoods. The starting material may also comprise some other lignocellulosic material, such as bagasse for instance.

BACKGROUND PRIOR ART

The manufacture of diverse paper qualities has long involved the intermixing of, e.g. mechanical pulps which have been bleached to a high degree of brightness. In present day paper manufacturing processes there is a desire to increase the use of bleached mechanical and chemimechanical pulps. The great drawback with these particular pulps, and one which has retarded their use in, e.g. paper manufacture, resides in the poor brightness stability of such pulps. The brightness of these pulps thus fades much too rapidly with time, i.e. the pulps are yellowing.

Attempts to find ways and means of retarding the tendencies of such pulps for yellowing have been undertaken for several decades. One method that has been proposed in an attempt to solve this problem on an industrial scale when producing paper which contains a bleached pulp that contains a high proportion of lignin involves coating the paper produced with an appropriate chemical, e.g. a pigment, such as titanium dioxide. This titanium dioxide coating makes it difficult for light to penetrate the paper sheet and prevents yellowing to a corresponding degree. This method of solving the problem is not particularly effective, however, and it can be said that the problem of yellowing has not been solved satisfactorily hitherto.

SUMMARY OF THE INVENTION

The technical problem

It will be evident from the aforegoing that the problem manifested in the pronounced yellowing of bleached lignin containing cellulose pulps, which among other things has been a deterent against the use of such pulps in, e.g., paper manufacturing processes, has hitherto not been solved.

Solution

The present invention solves this problem and relates to a method for treating bleached lignin containing cellulose pulp which is characterized in that subsequent to being bleached the cellulose pulp is:

(a) always treated with at least one chemical, which will chemically reduce α-carbonyl and γ-carbonyl groups in the lignin and in at least one further step is (b) treated with at least one chemical, which will block the phenolic hydroxyl groups of the lignin and/or (c) supplied with at least one chemical, which will convert short-wave light quanta to long-wave light quanta.

According to a preferred embodiment of the invention the cellulose pulp is always treated in accordance with both feature (a) and feature (b) above and is thereafter washed prior to being supplied with the chemical according to feature (c).

In those embodiments where it is elected to treat the pulp in accordance with both step (a) and step (b), the order in which these steps are effected is not of immediate importance, and can be reversed. The important thing is that the cellulose pulp is subjected to both a reduction and a blocking process. The step sequencies (a)+(b) and (b)+a) are thus quite interchangeable. When choosing the step sequence (b)+(a), the pulp is washed after step (a), although the pulp can also be washed after completing the initial step b) of this sequence.

When the cellulose pulp is treated in accordance with steps (a) and (c), the pulp must be washed after completing the first treatment step. In those cases when the cellulose pulp is treated in accordance with steps (a), (b) and (c), the pulp may be washed after completing the first treatment step, although this is not necessary or preferred. Contrary hereto it is preferred to dewater the pulp subsequent to its treatment with a reduction agent, at preferably low pulp concentrations, e.g. with the aid of a filter, and thereafter to remove further liquid from the pulp, e.g., in a press.

A preferred reduction agent is sodium borohydride. It has surprisingly been found that by also adding a complexing agent to the system it is possible to counteract to a very large extent the normal decomposition of the borohydride. However, in order to achieve this effect it is necessary also to fulfill a number of other parameters. For instance, it shall be ensured that the pH of the solution comprising the borohydride and the complexing agent is greater than 11, preferably around 11.5–12.0, and that the temperature of the solution is not higher than 40° C. Preferred chemicals which block the phenolic hydroxyl groups of the lignin are ethylene oxide or propylene oxide, or other epoxy compounds.

The last step of the pulp treatment process, with the exception of those cases when only steps a) and b) are employed, requires the addition of a fluorescent chemical. The addition or the treatment can either be effected in the pulp mill or in the paper mill, in the case of paper manufacture. The chemical concerned shall preferably be capable of converting short wave light to light which has a wavelength in excess of 400 nanometers.

Organic and inorganic fluorescent chemicals can both be used, although inorganic fluorescent compounds are the absolute preference.

Advantages

It is possible by means of the inventive method to bring down the yellowing of pulp to a fraction of what is at present experienced in practice.

This makes it possible to enhance the quality of those products which incorporate pulp treated by the inventive method, e.g. different types of paper. The benefit afforded hereby will also enable more relatively inexpensive lignin containing cellulose pulp to be included in the pulp furnish used in a paper manufacturing process, this inexpensive cellulose pulp consisting, e.g. of high yield pulp.

Examples of paper whose quality can be improved and/or the cost of manufacture of which can be reduced by means of the inventive method are writing paper, printing paper, newsprint, including both conventional paper and so-called LWC-paper (Light Weight Coated) and soft paper, so-called tissue. This improvement and/or cost reduction also applies to various types of paperboard and so-called liquid-board. The quality of cellulose pulp used for absorption purposes in the form of dry shredded pulp (fluff) can also be enhanced, by treating the pulp in accordance with the invention.

BEST EMBODIMENT

The inventive method will now be described in more detail, followed by a number of concrete working examples.

It will be understood from the aforegoing that the inventive method is intended for the after treatment of bleached lignin containing cellulose pulp, i.e. pulp that contains lignin.

According to a preferred embodiment of the invention, the treatment is begun by mixing a chemical reduction agent into the pulp suspension, which preferably has a low pulp concentration, e.g. 3%. The reduction agent may comprise a 1%-solution of sodium borohydride having a pH of. e.g., 11.5. The solution will also contain a given quantity of complexing agent, e.g. 0.2% (calculated on the dry weight of the pulp) of dietylene triamine pentaacetic acid (DTPA). The pulp suspension preferably has a temperature of 30° C. Shortly after mixing these chemicals into the system, liquid containing sodium borohydride and complexing agent is withdrawn from the pulp suspension to an extent sufficient to increase the pulp consistency to a level which lies within the range of 20–50%. The higher the pulp consistency the better the result achieved. The withdrawn solution is recycled and, after being refortified with said chemicals, is admixed with freshly supplied pulp.

The pulp, which has a concentration of 20–50%, is allowed to react with the reduction agent for a period of, e.g., two hours at a temperature of 30° C. The residual chemicals are then withdrawn from the pulp and the withdrawn liquid recycled and charged to fresh pulp. Since sodium borohydride is relatively expensive, it is endeavoured to keep the consumption of this chemical as low as possible. It has happily been found that good results are obtained with sodium borohydride solutions which have a concentration of less than 1%. It is possible in this regard to use concentrations as low as 0.1%.

The pulp is further dewatered to obtain the highest possible pulp concentration, e.g. a pulp concentration of 50%. The pulp is then reacted with, e.g., gaseous ethylene oxide or gaseous propylene oxide for a time period of, e.g., two hours at a temperature lying within the range of 60°–90° C. The pulp may have a pH of from 10.5–11.0.

The pulp is then washed to an essentially neutral pH.

At this stage there remains one further step in the treatment chain according to the preferred embodiment of the invention, namely the introduction of a fluorescent substance. As previously mentioned, this substance may be introduced into the pulp as early as in the pulp mill. This embodiment of the invention is preferred, e.g., when manufacturing pulps which subsequent to being dry shredded or fluffed are used in such absorption products as diapers and sanitary napkins. In this case, the fluorescent substance is preferably introduced when the cellulose pulp is in the form of a suspension of relatively low pulp consistency. The fluorescent substance is added either in powder form or as a dispersion.

According to two other embodiments of the invention, the fluorescent substance can be introduced into the pulp during the manufacture of paper on a paper machine.

According to one embodiment of the invention the fluorescent substance is introduced into the paper stock either prior to the stock entering the wet section of the paper machine or in conjunction with the passage of the stock through said wet section.

According to one preferred embodiment of the invention, the fluorescent substance is supplied to the finished paper, e.g. together with the starch when surface sizing the paper. The preferred method of supplying the fluorescent substance is highly beneficial from the aspect of economy, since far less fluorescent substance is used in conjunction with surface coating than when the whole pulp flow is treated with said substance.

As beforementioned, an inorganic fluorescent chemical is much more preferable in this context than an organic chemical. This is because the inorganic substances are much more stable and more durable than organic substances, and also have a longer life. For example, substances such as those applied to the inner surfaces of fluorescent lamps may be used advantageously. Examples of such substances are; willemite, scapolite, scheelite, wolframite, calcite and apatite, or mixtures of two or more of such substances. The particle size of these substance plays a significant part in achieving optimum results with regard to a reduction in the yellowing of e.g. the paper produced. Titanium dioxide, $TiO_2$, is another chemical which can be used in this context.

The following chemicals can be used as alternative reduction agents to sodium borohydride; Sulphite, dithionite and thiorea dioxide. It is also possible to use catalytic hydrogenation.

Blocking chemicals which can be used as an alternative to the aforesaid ethylene oxide, propylene oxide and other epoxy compounds, include acetic acid anhydride, benzoyl chloride, butylene oxide, chloroacetic acid, ketenes, dimethyl sulphate and didazomethane.

EXAMPLE 1

Experiments were carried out in the laboratory on factory-produced peroxide-bleached groundwood pulp.

The pulp was slushed in a solution which contained 1% sodium borohydride and 0.2% diethylene triamine pentaacetic acid (DTPA), calculated on bone dry pulp, such as to obtain a pulp suspension having a consistency of 3%. The pulp suspension had a pH of 11.5.

Liquid was withdrawn from the pulp suspension so as to leave a pulp consistency of 20%. The pulp was then allowed to react with the sodium borohydride for two hours at a temperature of 30° C., whereafter the pulp was washed clean of said chemicals. It was found that 4 kg of sodium borohydride was consumed with each tonne of bone dry pulp.

The pulp was dewatered once more so that a pulp consistency of 50% was obtained. To the pulp was added propylene oxide in liquid form in an amount of 1% counted on bone dry pulp. The temperature was then raised to 60° C., meaning that the propylene oxide was gasified, and this treatment was continued for 2 hours. The pulp was subsequently washed. It was established that the consumption of propylene oxide was 3 kg per tonne of bone dry pulp.

The pulp was formed into a large number of paper sheets on a Büchner funnel.

A few paper sheets were produced from the starting pulp in a similar manner, for reference purposes.

In addition, a few paper sheets were formed from the pulp subsequent to treating the pulp solely with sodium borohydride. Some paper sheets were also formed from pulp which had been treated solely with propylene oxide in accordance with the aforesaid parameters. None of these three pulps was treated in accordance with the invention, however, and the pulps are to be considered solely as comparison pulps.

In addition, paper sheets were formed from pulp which had been treated with both sodium borohydride and propylene oxide. According to the invention, it is possible to restrict treatment of the pulp to these two steps, i.e. in accordance with the steps (a)+(b) or reversed (b)+(a) recited in the main claim.

According to a second embodiment of the invention, a fluorescent chemical is introduced into pulp that has been treated with a reduction agent (e.g. sodium borohydride) in accordance with step (c). Accordingly, a paper sheet formed from pulp that had been treated with sodium borohydride was dipped into a dispersion which contained 5% of a chemical of the magnesium wolframate type.

According to one inventive embodiment of absolute preference, the pulp is treated in accordance with all three of the aforedescribed steps, i.e. steps (a)+(b)+(c). Consequently, paper sheets that had been treated in accordance with steps (a)+(b) were dipped into two mutually different dispersions having five different concentrations, in accordance with the disclosures made in the following Table I.

Subsequent to being dipped quickly into the aforesaid chemical dispersions, the paper sheets were dried and conditioned.

All of the aforesaid paper sheets were subjected to initial brightness and aged brightness tests in accordance with the method SCAN-C11:75, the brightness values obtained being expressed in % ISO. The aging tests were carried out in a xeno-test apparatus known by the name Landau.

The results achieved are set forth in the Table below.

TABLE I

| | Initial brightness % ISO | Aged brightness % ISO | Difference |
|---|---|---|---|
| Reference Paper Sheets | | | |
| Untreated pulp | 77.1 | 71.1 | 6 |
| Pulp treated with sodium borohydride (= step a)) | 81.2 | 76.7 | 4.5 |
| Pulp treated with propylene oxide (= step b)) | 73.3 | 69.1 | 4.2 |
| Paper sheets produced inaccordance with the invention | | | |
| Pulp treated with sodium borohydride and propylene oxide (step a) + step b)) | 81.3 | 78.3 | 3.0 |
| The above pulp treated with the folowing chemicals (step a) + step b) + step c)) | | | |
| Fluorescent chemical of the calcium halophosphate type (apatite) | | | |
| 1% dispersion | 81.1 | 75.5 | 5.6 |
| 2% dispersion | 82.3 | 77.9 | 4.4 |
| 3% dispersion | 82.8 | 78.9 | 3.9 |
| 4% dispersion | 84.2 | 80.5 | 3.7 |
| 5% dispersion | 84.6 | 80.7 | 3.9 |
| Fluorescent chemical of the magnesium wolframate type (wolframite) | | | |
| 1% dispersion | 78.9 | 74.2 | 4.7 |
| 2% dispersion | 79.9 | 75.8 | 4.1 |
| 3% dispersion | 81.1 | 77.7 | 3.4 |
| 4% dispersion | 82.3 | 79.9 | 2.4 |
| 5% dispersion | 85.4 | 84.1 | 1.3 |
| Pulp treated with sodium borohydride and supplied with a 5%-dispersion of the magnesium wolframate type (step a) + step c)) | 85.0 | 82.3 | 2.7 |

It will be seen from the test results recited above that a decreased yellowing of the sheets produced from pulp treated in accordance with the invention was obtained as compared to the yellowing experienced with the reference tests, and then particularly in combination with an enhanced initial brightness, which is, in itself, surprising.

When the paper sheet produced from pulp that had been treated with propylene oxide is compared with the paper sheet produced from untreated pulp, it is seen that although yellowing is less pronounced the level of brightness of the sheet has been lowered in a catastropic way.

With regard to the paper sheet produced from pulp that had been treated with sodium borohydride, it is seen that while there is a clear improvement in the initial brightness, the improvement achieved with regard to yellowing is not equally as pronounced as that achieved with the paper sheet produced from pulp that had been treated with propylene oxide.

The paper sheet that was produced in accordance with steps (a)+(b) in accordance with the invention exhibited a good initial brightness and also showed a market reduction in yellowing, when compared with the paper sheet for reference purposes.

The paper sheets prepared in accordance with the absolutely preferred embodiment of the present invention, i.e. in accordance with steps (a)+(b)+(c) show a dramatic improvement in the initial brightness with a simultaneous decrease in yellowing to surprisingly low levels, namely to ca 1% ISO in some cases. Judging from these tests, it would seem that yellowing decreases, in the main, with increasing quantities of the fluorescent chemical added.

Equally as good results were not obtained, however, with the paper sheet that was treated solely in accordance with the inventive steps (a) and (c), although the results obtained were clearly better than the results obtained with the paper sheets used for reference purposes.

EXAMPLE 2

It has earlier been difficult to prevent sodium borohydride, which is an excellent reduction agent, from decomposing and/or hydrolyzing to boric acid. This chemical is comparatively expensive, and one condition for its economic use in practicing the method of the invention is that decomposition of the chemical can be reduced to a minimum.

Consequently, attempts have been made to render the dissolved sodium borohydride stable. Success was achieved in this regard, by adding a complexing agent and adjusting the system to a given pH and a given temperature.

A solution containing 1% $NaBH_4$ and 1% DTPA was prepared. In addition hereto there was prepared a further solution which contained solely 1% $NaBH_4$.

The results obtained are set forth in Table 2 below.

TABLE II

| DTPA | pH | Temperature °C. | Decomposition of $NaBH_4$ % |
|---|---|---|---|
| 0 | 10.5 | 50 | 48 |
| + | 10.5 | 50 | 41 |
| 0 | 11.5 | 50 | 24 |
| + | 11.5 | 50 | 14 |
| 0 | 11.5 | 70 | 88 |
| + | 11.5 | 30 | 0 |

It will be seen from these results that a totally stable sodium borohydride solution can be obtained, by adding a complexing agent and by employing a relatively high pH of 11.5, and a relatively low temperature, of 30° C.

EXAMPLE 3

Laboratory tests were carried out on factory produced chemithermomechanical pulp that had been bleached with peroxide.

The pulp was slushed in a solution that contained 1% sodium borohydride and 0.2% diethylene triamine pentaacetic acid (DTPA), calculated on bone dry pulp, so as to obtain a pulp suspension having a consistency of 3%. The pulp suspension had a pH of 11.5.

Liquid was drawn from the pulp suspension, so as to obtain a pulp consistency of 20%. The pulp was then allowed to react with the sodium borohydride for two hours at a temperature of 30° C. The pulp was then washed clean of said chemicals and it was found that 3.8 kg of sodium borohydride had been consumed with each tonne of bone dry pulp.

The pulp was dewatered so as to obtain a pulp consistency of 50%. Liquid propylene oxide was added to the pulp in an amount of 1% calculated on bone dry pulp. The temperature was then raised to 60° C., resulting in gasification of the propylene oxide and the pulp was treated thus for two hours. The pulp was then washed with water and the consumption of propylene oxide measured. It was found that 3.5 kg of propylene oxide was consumed with each tonne of bone dry pulp. The pulp was formed into paper sheets, with the aid of a Büchner funnel.

These paper sheets were supplied with two separate fluorescent chemicals, by dipping the sheets quickly into a dispersion having a 5%-concentration. The fluorescent chemicals used were of the calcium halophosphate type and the magnesium wolframate type. The paper sheets were then dried and conditioned, whereafter the initial brightness and aged brightness of the sheets were determined in accordance with the method SCAN-C11:75 and the results expressed in % ISO.

A paper sheet was also produced from the original pulp, with the aid of a Büchner funnel, as was a paper sheet from pulp that had been treated with sodium borohydride. These two paper sheets were used for reference purposes.

In addition to the paper sheets previously described and produced in accordance with the invention, a paper sheet was produced from pulp that had been treated with sodium borohydride and propylene oxide, i.e. in accordance with steps a)+b) of the inventive method. A paper sheet produced from pulp that had been treated with sodium borohydride was dipped into a 5%-dispersion of magnesium wolframate, i.e. in accordance with steps a)+c) of the inventive method.

The results obtained are set forth in Table 3 below.

TABLE III

| | Initial brightness % ISO | Aged brightness % ISO | Difference |
|---|---|---|---|
| Reference paper sheet | | | |
| Untreated pulp | 72.3 | 67.2 | 5.1 |
| Pulp treated with sodium borohydride (= step a)) | 78.0 | 72.4 | 5.6 |
| Paper sheets produced in accordance with the invention | | | |
| Pulp treated with sodium boro- | 77.8 | 73.6 | 4.2 |

TABLE III-continued

| | Initial brightness % ISO | Aged brightness % ISO | Difference |
|---|---|---|---|
| hydride and propylene oxide (step a) + step b)) | | | |
| Pulp treated with sodium borohydride and propylene oxide with an addition of one of the following chemicals (step a) + step b) + step c)) | | | |
| Fluorescent chemical of the calcium halophosphate type (apatite) 5% dispersion | 80.6 | 76.5 | 4.1 |
| Fluorescent chemical of the magnesium wolframate type (wolframite) 5% dispersion | 81.6 | 79.7 | 1.9 |
| Pulp treated with sodium borohydride and supplied with a 5%-dispersion of the magnesium wolframate type (step a) + step c)) | 81.8 | 78.9 | 2.9 |

It will be seen herefrom that the results achieved when applying the invention to a chemithermomechanical pulp are the same as those achieved in Example 1.

The best result was obtained with the embodiment of the invention of absolute preference, i.e. the full treatment in accordance with steps (a)+(b)+(c).

The next best result was obtained in accordance with the embodiment of the invention when solely step a)+-step c) were practiced on the original pulp.

EXAMPLE 4

Laboratory tests were carried out on peroxide bleached thermomechanical pulp (TMP) produced in the laboratory.

The tests were identical with those described in Example 3, with the exception that no paper sheet was formed from pulp that had been treated solely with sodium borohydride.

The results obtained are set forth in Table 4 below.

TABLE IV

| | Initial brightness % ISO | Aged brightness % ISO | Difference |
|---|---|---|---|
| Reference paper sheet | 75.2 | 69.1 | 6.1 |
| Untreated pulp | | | |
| Paper sheets produced according to the invention | | | |
| Pulp treated with sodium borohydride and propylene oxide (step a) + step b)) | 78.5 | 75.2 | 3.3 |
| The above pulp plus an addition of a fluorescent chemical | | | |
| of the calcium halophosphate type (apatite) 5%-dispersion | 81.7 | 78.7 | 3.0 |
| of the magnesium wolframate type (wolframite) 5%-dispersion | 82.9 | 80.2 | 2.7 |
| Pulp treated with sodium borohydride and supplied with a 5%-dispersion of magnesium wolframate type (step a) + step c)) | 83.0 | 80.0 | 3.0 |

It will be seen herefrom that the results obtained when practicing the invention on thermomechanical pulp are approximately the same as those obtained when practicing the invention on mechanical pulp (groundwood pulp) and chemithermomechanical pulp.

We claim:

1. A method for treating bleached cellulose pulp containing lignin subsequent to bleaching the pulp, comprising:

(a) adding at least one reducing agent to the bleached pulp in an amount effective to chemically reduce $\alpha$-carbonyl and $\gamma$-carbonyl groups in the lignin, (b) prior to, simultaneously with, or after step (a), adding at least one blocking agent to the bleached pulp in an amount effective to block the phenolic hydroxyl groups of the lignin, and (c) adding at least one compound to the chemically reduced and blocked bleached pulp of steps (a) and (b) in an amount effective to convert short-wave light quanta to long-wave quanta.

2. A method according to claim 1, further comprising washing the bleached pulp after the pulp is treated according to both step (a) and step (b).

3. A method according to claim 1, wherein said blocking agent is ethylene oxide or propylene oxide.

4. A method according to claim 1, wherein said reducing agent is selected from the group consisting of sodium borohydride, sulfite, dithionite and thiorea dioxide, said blocking agent is ethylene oxide or propylene oxide and wherein said at least one compound is selected from the group consisting of willemite, scapolite, scheelite, wolframite, calcite, apatite, titanium dioxide, and mixtures of two or more of these agents.

5. The method according to claim 1, wherein said at least one blocking agent is added to the bleached pulp prior to step (a).

6. The method according to claim 1, wherein said at least one blocking agent is added to the bleached pulp simultaneously with step (a).

7. The method according to claim 1, wherein said at least one blocking agent is added to the bleached pulp after step (a).

8. A method for treating bleached cellulose pulp containing a high lignin content subsequent to bleaching the pulp, comprising:

(a) adding at least one reducing agent to the bleached pulp containing a high lignin content in an amount effective to chemically reduce $\alpha$-carbonyl and $\gamma$-carbonyl groups in the lignin, and (b) adding at least one compound to the reduced bleached pulp of step (a) in an amount effective to convert short-wave light quanta to long-wave light quanta.

9. A method according to claim 8, further comprising washing the bleached pulp after step (a).

10. A method according to claims 1 or 8, wherein said reducing agent is selected from the group consisting of sodium borohydride, sulfite, dithionite and thiourea dioxide.

11. A method according to claim 10, wherein said reducing agent is sodium borohydride.

12. A method according to claim 11, further comprising adding a complexing agent to the bleached pulp.

13. A method according to claim 12, wherein said sodium borohydride and said complexing agent are added to the bleached pulp in the form of a solution which has a pH greater than 11 and wherein the addition is carried out at a temperature below 40° C.

14. A method according to claims 1 or 8, wherein said at least one compound is an organic or inorganic fluorescent agent.

15. A method according to claim 14, wherein said at least one compound is an inorganic fluorescent agent.

16. A method according to claim 14, wherein said fluorescent agent is selected from the group consisting of willemite, scapolite, scheelite, wolframite, calcite, apatite, titanium dioxide, and mixtures of two or more of these agents.

17. A method according to claim 14, wherein said fluorescent agent converts short-wave light to light having a wavelength above 400 nanometers.

18. A method according to claim 14, wherein said fluorescent agent is added to the cellulose pulp in a pulp mill.

19. A method according to claim 14, wherein said fluorescent agent is added to paper formed from the bleached pulp in a paper mill.

* * * * *